US006159309A

United States Patent [19]

Kurosaki et al.

[11] Patent Number: 6,159,309

[45] Date of Patent: Dec. 12, 2000

[54] GRAIN-ORIENTED ELECTRICAL STEEL SHEET AND METHOD FOR PRODUCING SAME

[75] Inventors: Yousuke Kurosaki; Norito Abe; Nobuo Tachibana; Kentaro Chikuma; Kiyokazu Ichimura; Sadanobu Hirokami; Masayuki Yamashita, all of Himeji, Japan

[73] Assignee: Nippon Steel Corporation, Tokyo, Japan

[21] Appl. No.: 09/180,125

[22] PCT Filed: Apr. 15, 1998

[86] PCT No.: PCT/JP98/01718

§ 371 Date: Nov. 2, 1998

§ 102(e) Date: Nov. 2, 1998

[87] PCT Pub. No.: WO99/46416

PCT Pub. Date: Sep. 16, 1999

[30] Foreign Application Priority Data

Mar. 11, 1998 [JP] Japan ..... 10-60215
Mar. 11, 1998 [JP] Japan ..... 10-60216

[51] Int. Cl.[7] ..... C21D 8/12; C22C 38/02

[52] U.S. Cl. ..... 148/308; 148/111; 148/112; 148/113

[58] Field of Search ..... 48/111, 112, 113, 48/308

[56] References Cited

U.S. PATENT DOCUMENTS 4,579,608 4/1986 Shimizu et al. ..... 148/308

FOREIGN PATENT DOCUMENTS 6-73509 3/1993 Japan .
6-179917 6/1994 Japan .
7-310124 11/1995 Japan .
8-134660 5/1996 Japan .

*Primary Examiner*—Deborah Yee
*Attorney, Agent, or Firm*—Kenyon & Kenyon

[57] ABSTRACT

The present invention provides a grain-oriented electrical steel sheet having magnetic properties equal to, or higher than, those of conventional steel sheets can be produced economically with high productivity, and a method for producing such a steel sheet. The producing method comprises the steps of using, as a starting material, a coil obtained by heating a slab having a composition comprising, in terms of percent by weight, 0.02 to 0.15% of C, 2.5 to 4.0% of Si, 0.02 to 0.20% of Mn, 0.015 to 0.065% of Sol. Al, 0.0030 to 0.0150% of N, 0.005 to 0.040% as the sum of at least one of S and Se and the balance substantially consisting of Fe and hot rolling the slab to a coil, or a coil directly cast from a molten steel having the same components as the slab, conducting hot rolled sheet annealing at 900 to 1,100° C., one stage cold rolling the sheet by a tandem mill having a plurality of stands, conducting decarburization annealing, further conducting final finish annealing, and then applying final coating so that a product having a thickness of 0.20 to 0.55 mm, an average grain diameter size of 1.5 to 5.5 mm, a $W_{17/50}$ value expressed by the formula given below and a $B_8$ value satisfying the relation $1.80 \leqq B_8\ (T) \leqq 1.88$:

$$0.5884e^{1.9154t} \leqq W17/50\ (W/kg) \leqq 0.7558e^{1.7378t}$$

[t: sheet thickness.]

11 Claims, 4 Drawing Sheets

GRAIN-ORIENTED ELECTRICAL STEEL SHEET AND METHOD FOR PRODUCING SAME

TECHNICAL FIELD

This invention relates to a grain-oriented electrical steel sheet having an improved orientation of the {110}<001> texture for use as an iron core of a transformer, etc, and a method of producing such a steel sheet.

BACKGROUND ART

A grain-oriented electrical steel sheet has been mainly used as a core material of electric appliances such as transformers, and must have excellent magnetic properties such as excitation characteristics, iron loss characteristics, and so forth. A magnetic flux density B in a magnetic field of 800 A/m (hereinafter called "$B_8$" in the present invention) is ordinarily used as the numerical value representing the excitation characteristics, while $W_{17/50}$ is used as a typical numerical value representing the iron loss characteristics.

The magnetic flux density is one of the very important factors that govern the iron loss characteristics. Generally speaking, the higher the magnetic flux density, the better the iron loss. When the magnetic flux density becomes excessively high, however, secondary recrystallization grains become coarse, so that an abnormal eddy current loss becomes increase and the core loss may deteriorate. In other words, the secondary recrystallization grains must be appropriately controlled.

The iron loss comprises a hysteresis loss and an eddy current loss. The former is associated with purity, internal strain, etc, besides the crystal orientation of a steel sheet and the latter is associated with an electric resistance, a sheet thickness, etc, of the steel sheet.

The iron loss can be reduced by improving the purity and removing the internal strain as much as possible, as is well known in the art.

The iron loss can be reduced also by improving the electric resistance and reducing the sheet thickness. One of the methods of improving the electric resistance increases the Si content, for example, but this method has a limit because the production process or the workability of the product deteriorate when the Si content is increased.

Similarly, because a reduction in the sheet thickness results in the drop of productivity, an increase in the production cost will occur. Therefore, there is also a limit to the reduction of the sheet thickness.

A grain-oriented electrical steel sheet can be obtained by causing secondary recrystallization in finish annealing so as to develop a so-called "Goss texture" having {110} in the direction of the sheet plane and <001> in a rolling direction.

Typical production process of the grain-oriented electrical steel sheet are described in U.S. Pat. No. 1,965,559 owned by N. P. Goss, U.S. Pat. No. 2,533,351 owned by V. W. Carpenter and U.S. Pat. No. 2,599,340 owned by M. F. Littmann et al.

These production processes features that MnS is used as a principal inhibitor so as to cause the secondary recrystallization of the Goss texture at a high temperature during finish annealing, a slab is heated at a high temperature of not lower than 1,800° F. so as to cause solid solution of MnS and cold rolling and annealing inclusive of intermediate annealing are carried out a plurality of times after hot rolling and before high temperature finish annealing. From the aspect of the magnetic properties, this grain-oriented electrical steel sheet satisfies the relationships of $B_{10}$=1.80 T and $W_{10/60}$=0.45 W/lb (2.37 W/kg in terms of $W_{17/50}$).

As described above, the iron loss characteristics of the grain-oriented electrical steel sheet results from various factors. The method of producing the grain-oriented electrical steel sheet requires a longer production process and is more complicated than production methods of other steel products. Therefore, in order to obtain stable quality, a greater number of control items exist and this problem is a great burden to operating engineers. Needless to say, this problem greatly affects the production yield.

On the other hand, grain-oriented electrical steel sheets includes two types of the steel sheets, i.e. a high flux density grain-oriented electrical steel sheet having $B_8$(T) of at least 1.88 (JIS standard) and a CGO (Commercial Grain Oriented Silicon Steel) having a flux density of not higher than 1.88. The former mainly uses AlN, (Al•Si)N, Sb, MnSe, MnS, etc, as the inhibitor whereas the latter mainly uses MnS as the inhibitor. The producing methods vary also depending on the types of the products described above. Namely, the former includes a single (or one stage) cold rolling method and a double cold rolling method while the latter includes a second stage cold rolling method. In other words, there is hardly the case where the grain-oriented electrical steel sheet of the CGO grade is produced by the single cold rolling method, and the development of the grain-oriented electrical steel sheet of the CGO grade which can be produced by a shorter process and at a lower cost of production has been earnestly desired.

SUMMARY OF THE INVENTION

To solve these problems of the grain-oriented electrical steel sheet, the present invention provides a grain-oriented electrical steel sheet exhibiting an excellent iron loss characteristic curve by fundamentally investigating the components such as the Si content, the sheet thickness, the average grain diameter of the product and the combination of textures, etc, and simplifying the producing process to an extent that has not been achieved so far.

The first feature of the present invention relates to a grain-oriented electrical steel sheet which contains, in terms of percent by weight, 2.5 to 4.0% of Si, 0.02 to 0.20% of Mn and 0.005 to 0.050% of acid-insoluble Al, and has an average grain diameter of 1.5 to 5.5 mm, a $W_{17/50}$ of iron loss value expressed by the formula given below and a $B_8$(T) value satisfying the relation $1.80<B_8(T)<1.88$ at a sheet thickness of 0.20 to 0.55 mm:

$$0.5884e^{1.9154t} \leqq W17/50(W/kg) \leqq 0.7558e^{1.7378t}$$

[t: sheet thickness (mm)]

The second feature of the present invention relates to a grain-oriented electrical steel sheet which contains, in terms of percent by weight, 1.5 to less than 2.5% of Si, 0.02 to 0.20% of Mn and 0.005 to 0.050% of acid-insoluble Al, and has a mean crystal grain size of 1.5 to 5.5 mm, a $W_{17/50}$ of iron loss value expressed by the formula given below and a $B_8$(T) value satisfying the relation $1.88<B_8(T)<1.95$ at a sheet thickness of 0.20 to 0.55 mm:

$$0.5884e^{1.9154t} \leqq W17/50(W/kg) \leqq 0.7558e^{1.7378t}$$

[t: sheet thickness (mm)]

The third feature of the present invention according to the first or second features relates to a grain-oriented electrical steel sheet which further contains 0.003 to 0.3%, in terms of each element amount, of at least one element selected from the group consisting of Sb, Sn, Cu, Mo and B.

In a method for producing a grain-oriented electrical steel sheet by using, as a starting material, a hot rolled coil obtained by heating a slab and hot rolling, or a coil directly cast from a molten steel having a composition comprising, in terms of percent by weight, 0.02 to 0.15% of C, 2.5 to 4.0% of Si, 0.02 to 0.20% of Mn, 0.015 to 0.065% of Sol. Al, 0.0030 to 0.0150% of N, 0.005 to 0.040% as the sum of at least one of S and Se, and the balance consisting substantially of Fe, by slab heating, hot rolling, hot rolled coil annealing, and then serially cold rolling, decarburization annealing, final finish annealing and final coating, the fourth feature of the present invention relates to a method for producing a grain-oriented electrical steel sheet characterized in that hot rolled coil annealing is carried out at 900 to 1,100° C. so that a steel sheet has a sheet thickness of 0.20 to 0.55 mm, an average grain diameter of 1.5 to 5.5 mm, a $W_{17/50}$ iron loss value expressed by the formula given below and a $B_8(T)$ value satisfying the relation $1.80 \leqq B_8(T) \leqq 1.88$:

$$0.5884e^{1.9154t} \leqq W17/50(W/kg) \leqq 0.7558e^{1.7378t}$$

[t: sheet thickness (mm)]

In a method for producing a grain-oriented electrical steel sheet by using a coil, as a starting material, obtained by hot rolling a slab having a composition comprising, in terms of percent by weight, 0.02 to 0.15% of C, 1.5 to less than 2.5% of Si, 0.02 to 0.20% of Mn, 0.015 to 0.065% of Sol. Al, 0.0030 to 0.0150% of N, 0.005 to 0.040% as the sum of at least one of S and Se and the balance substantially consisting of Fe, by slab heating and hot rolling the slab, or a coil directly cast from a molten steel, hot rolling the slab, annealing the hot rolled coil and then carrying out serially cold rolling, decarburization annealing, final finish annealing and final coating, the fifth feature of the present invention relates to a method for producing a grain-oriented electrical steel sheet characterized in that hot rolled coil annealing is carried out at 900 to 1,100° C. so that the grain-oriented electrical steel sheet has a sheet thickness of 0.20 to 0.55 mm, an average grain diameter of 1.5 to 5.5 m, a $W_{17/50}$ of iron loss value expressed by the formula given below and a $B_8(T)$ value satisfying the relation $1.88 \leqq B_8(T) \leqq 1.95$:

$$0.5884e^{1.9154t} \leqq W17/50(W/kg) < 0.7558e^{1.7378t}$$

[t: sheet thickness (mm)]

The sixth feature of the present invention according to the fourth or fifth features relates to a method for producing a grain-oriented electrical steel sheet which contains 0.003 to 0.3%, in terms of weight % of each element, of at least one element selected from the group consisting of Sb, Sn, Cu, Mo and B.

The seventh feature of the present invention according to the sixth feature relates to a method for producing a grain-oriented electrical steel sheet, wherein cold rolling is carried out at a reduction ratio of 65 to 95%.

The eighth characterizing feature of the present invention according to the sixth feature relates to a method for producing a grain-oriented electrical steel sheet, wherein cold rolling is carried out at a reduction ratio of 80 to 86%.

The ninth feature of the present invention according to the seventh or eighth features resides in a method for producing a grain-oriented electrical steel sheet, wherein cold rolling is carried out by a tandem mill or zendimier mill having a plurality of stands.

The tenth feature of the present invention according to any of features of fourth to ninth features resides in a method for producing a grain-oriented electrical steel sheet, wherein heating the slab in a high temperature zone of not lower than 1,200° C. is carried out at a heating rate of at least 5° C./min and the slab is heated to 1,320 to 1,490° C.

The eleventh feature of the present invention according to the tenth feature relates to a method for producing a grain-oriented electrical steel sheet, wherein the slab to be heated to a temperature within the range of 1,320 to 1,490° C. is a slab to which hot deformation is applied at a reduction ratio of not higher than 50%.

THE MOST PREFERRED EMBODIMENTS

Figure 1:
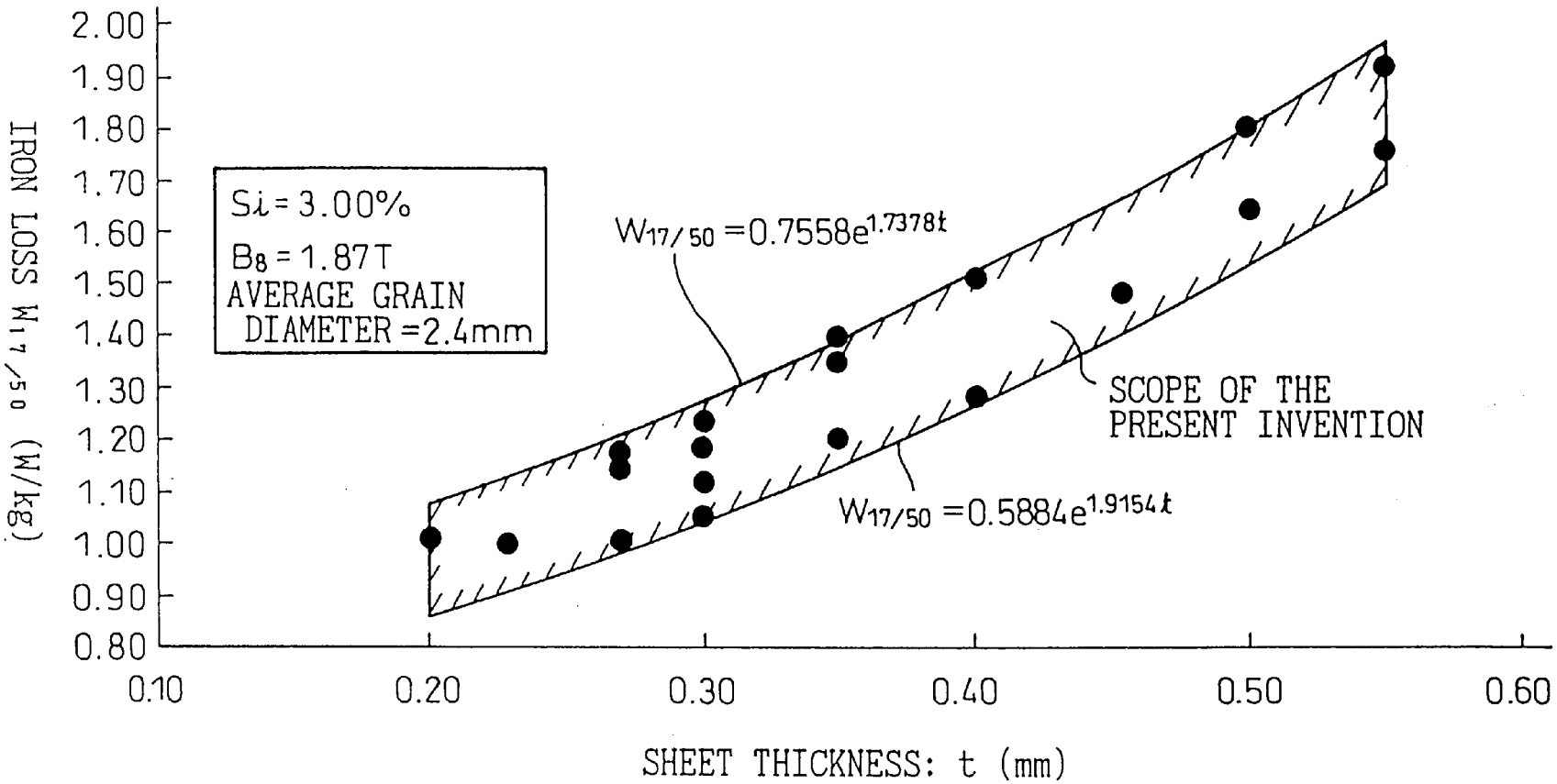
FIG. 1 is a graph showing the relationship between the sheet thickness of a product containing Si: 3.00%, Mn: 0.08%, acid-insoluble Al: 0.02% having $B_8$=1.87 T and $W_{17/50}$.

Hereinafter, the present invention will be explained in further detail.

The inventors of the present invention have conducted various studies on the conditions providing the iron loss characteristics and the production process of such a grain-oriented electrical steel sheet, and have succeeded in providing a grain-oriented electrical steel sheet of the grade generally called "CGO" having excellent iron loss characteristics by one stage cold rolling method by fundamentally investigating the components such as the Si content, the sheet thickness, the product average grain diameter and the combination of the crystal orientations, and simplifying the production process to such an extent that has never been achieved so far.

The reasons for limitation of the component composition of the product will be explained.

The C content of less than 0.02% is not desirable because grains grow abnormally at the time of slab heating before hot rolling, and a secondary recrystallization defect called "streaks" occurs in the product. When the C content exceeds 0.15%, on the other hand, a longer decarburization time is necessary in decarburization annealing after cold rolling. This is not only uneconomical but is also likely to invite an incomplete decarburization defect, so that a magnetic defect called "magnetic aging" occurs in the product.

If the Si content is less than 1.5%, an eddy current loss increases in the product. If it exceeds 4.0%, on the other hand, cold rolling at normal temperature becomes undesirably difficult.

Mn is a principal inhibitor element that governs the secondary recrystallization for obtaining the magnetic properties as the grain-oriented electrical steel sheet. If the Mn content is less than 0.02%, the absolute amount of MnS for causing the secondary recrystallization becomes insufficient and if it exceeds 0.20%, on the other hand, a dissolution of MnS at the time of slab heating becomes more difficult. Moreover, the precipitation size becomes coarser during hot rolling and the appropriate size distribution as an inhibitor is lost. Mn has the effects of increasing the electric resistance and reducing the eddy current loss. If the Mn content is less than 0.02%, the eddy current loss increases and if it exceeds 0.20%, the effect of Mn is saturated.

Acid-soluble Al is also a principal inhibitor element for a grain-oriented electrical steel sheet. If such an Al content is less than 0.015%, the amount is not sufficient and the inhibitor strength drops undesirably. If it exceeds 0.065%, on the other hand, AlN to be precipitated as the inhibitor becomes coarser and eventually, the inhibitor strength drops undesirably.

Acid-insoluble Al is contained as acid-soluble Al at the molten metal stage. It is used as the principal inhibitor for the secondary recrystallization in the same way as Mn and at the same time, it reacts with the oxide applied as the annealing separator and constitutes a part of the insulating film formed on the surface of the steel sheet. When this Al content is outside the range of 0.005 to 0.050%, the appropriate state of the inhibitor is collapsed and the glass film formation state is adversely affected, as well. In consequence, the iron loss reducing effect by the glass film tension is undesirably eliminated.

S and Se are the important elements for forming MnS and MnSe with Mn, respectively. The inhibitor effect cannot be obtained sufficiently if their contents are outside the respective ranges described above, and the sum of one or both of them must be limited to the range of 0.005 to 0.040%.

N is the important element that forms AlN with acid-soluble Al described above. When the N content is out of the range described above, the inhibitor effect cannot be obtained sufficiently. Therefore, the N content must be limited to the range of 0.0030 to 0.0150%.

Furthermore, Sn is effective as the element for obtaining the stable secondary recrystallization of thin gauge products and has also the function of refining the secondary recrystallization grain diameter. To obtain such an effect, Sn must be added in the amount of at least 0.003%. When the Sn content exceeds 0.30%, the effect gets into saturation. From the aspect of the increase of the production cost, therefore, the upper limit is set to up to 0.30%.

Cu is effective as an element that improves the glass film of the Sn containing steel and is also effective for obtaining stable secondary recrystallization. If the Cu content is less than 0.003%, the effect is not sufficient and if it exceeds 0.30%, the magnetic flux density of the product drops undesirably.

Sb, Mo and/or B are effective elements for obtaining the stable secondary recrystallization. To obtain this effect, at least 0.0030% of Sb, Mo and/or B must be added and if the amount exceeds 0.30%, the effect is saturated. From the aspect of the increase of the production cost, the upper limit is set to not greater than 0.30%.

If the product sheet thickness is less than 0.20 mm, the hysteresis loss increases or productivity drops undesirably. If it exceeds 0.55 mm, on the other hand, the eddy current loss increases and the decarburization time becomes longer, so that productivity drops.

If the average grain diameter of the product is smaller than 1.5 mm, the hysteresis loss increases desirably. When it exceeds 5.5 mm, the eddy current loss increases undesirably. For reference, U.S. Pat. No. 2,533,351 and U.S. Pat. No. 2,599,340 stipulate the average grain diameter of the product to 1.0 to 1.4 mm.

Next, the method for producing the grain-oriented electrical steel sheet according to the present invention will be explained.

The raw material of the grain-oriented electrical steel sheet, the components of which are regulated as described above, is cast as a slab or is directly cast as a steel strip. When the material is cast as the slab, it is processed into a coil by an ordinary hot rolling method.

It is the feature of the present invention that the hot rolled coil is subsequently subjected to hot rolled coil annealing, and after it is reduced to a final sheet thickness by one stage cold rolling, the process steps after decarburization annealing is carried out.

This hot rolled coil annealing is characterized in that annealing is carried out at a temperature between 900° C. and 1,100° C. Annealing is carried out for 30 seconds to 30 minutes for a precipitation control of AlN. If annealing is conducted at a temperature higher than 1,100° C., the secondary recrystallization defect is more likely to occur due to coarsening of the inhibitor.

A heavy reduction ratio of 65 to 95% is preferred as the cold rolling ratio.

The decarburization annealing condition is not particularly limited, but this annealing is preferably carried out at a temperature within the range of 700 to 900° C. for 30 seconds to 30 minutes, in a wet hydrogen atmosphere or in a mixed atmosphere of hydrogen and nitrogen.

To prevent seizure in the secondary recrystallization and to form an insulating film, an annealing separator is applied by an ordinary method to the surface of the steel sheet after decarburization annealing.

Secondary recrystallization annealing is carried out at a temperature not lower than 1,000° C. for at least 5 hours in a hydrogen or nitrogen atmosphere or in a mixed atmosphere.

After the excessive annealing separator is removed, continuous annealing is thereafter carried out to correct the coil set and at the same time, the insulating and tensioning film is applied and baked.

FIG. 1 shows the relationship between the sheet thickness and $W_{17/50}$ of the product containing Si: 3.00%, Mn: 0.08%, acid-insoluble Al: 0.02% and $B_8$=1.87 T obtained by the steps of hot rolling a slab containing C: 0.065%, Si: 3.00%, Mn: 0.08%, S: 0.026%, acid-soluble Al: 0.030% and N: 0.0089%, annealing the hot coil at 1,100° C. after hot rolling, conducting final cold rolling to a thickness of 0.20 to 0.55 mm by one stage cold rolling, and thereafter conducting decarburization annealing and secondary recrystallization annealing.

The grain-oriented electrical steel sheet exhibiting an excellent iron loss characteristic curve as expressed by the formula (1) given below can be obtained by fundamentally research into the components such as the Si content, the sheet thickness, the product average grain diameter and the combination of the textures and simplifying the production steps to such an extent that has not been achieved in the past:

$$0.5884e^{1.9154t} \leq W17/50(W/kg) \leq 0.7558e^{1.7378t} \quad (1)$$

[t: sheet thickness (mm)]

Figure 2:
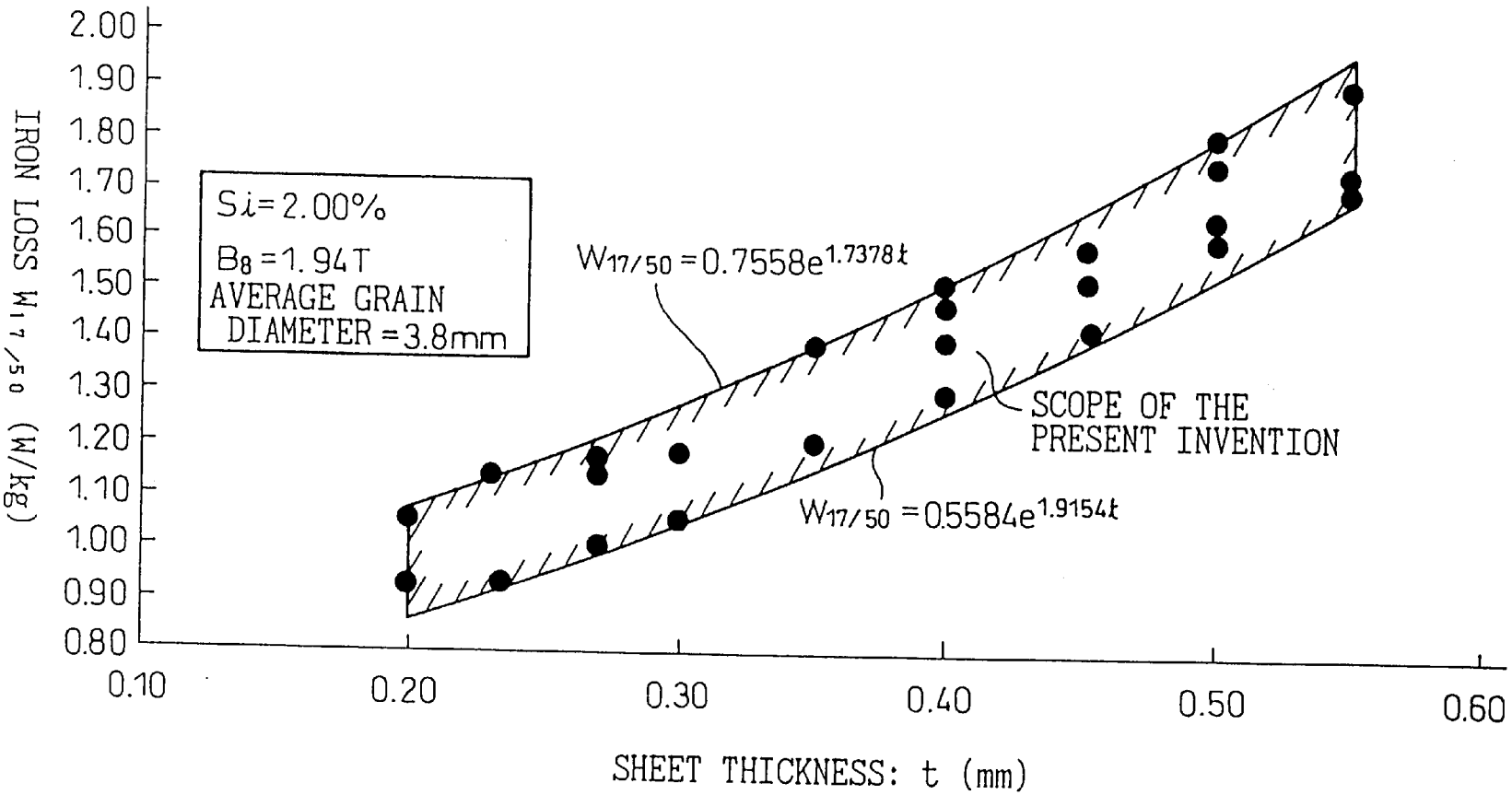
FIG. 2 is a graph showing the relationship between the sheet thickness of a product containing Si: 2.00%, Mn: 0.08%, acid-insoluble Al: 0.022% having $B_8$=1.94 T and $W_{17/50}$.

FIG. 2 shows the relationship between the sheet thickness and $W_{17/50}$ of the product containing Si: 2.00%, Mn: 0.08%, acid-insoluble Al: 0.022% and $B_8$=1.94 T and obtained by the steps of hot rolling a slab containing C: 0.039%, Si: 2.00%, Mn: 0.08%, S: 0.026%, acid-soluble Al: 0.030% and N: 0.0078%, hot coil annealing the slab at 1,090° C. after hot rolling, conducting final cold rolling of the hot coil to a thickness of 0.20 to 0.55 mm by one stage cold rolling, and thereafter conducting decarburization annealing and secondary recrystallization annealing.

The grain-oriented electrical steel sheet having the excellent iron loss characteristic curve expressed by the formula (1) described above can be obtained by fundamentally research into the components such as the Si content, the sheet thickness, the product average grain diameter and further, the combination of the textures, and simplifying the production process to such an extent that has not been achieved in the conventional CGO production process.

Next, the producing method of the present invention will be explained in detail.

The molten steel the components of which are regulated as described above is cast to a slab, or is directly cast to a steel strip. When the molten steel is cast to the slab, it is processed to a hot coil by an ordinary hot rolling process through slab heating steps.

When the slab is heated, heating in a high temperature range exceeding 1,200° C. is preferably carried out at a heating rate of at least 5° C./min.

Figure 3:
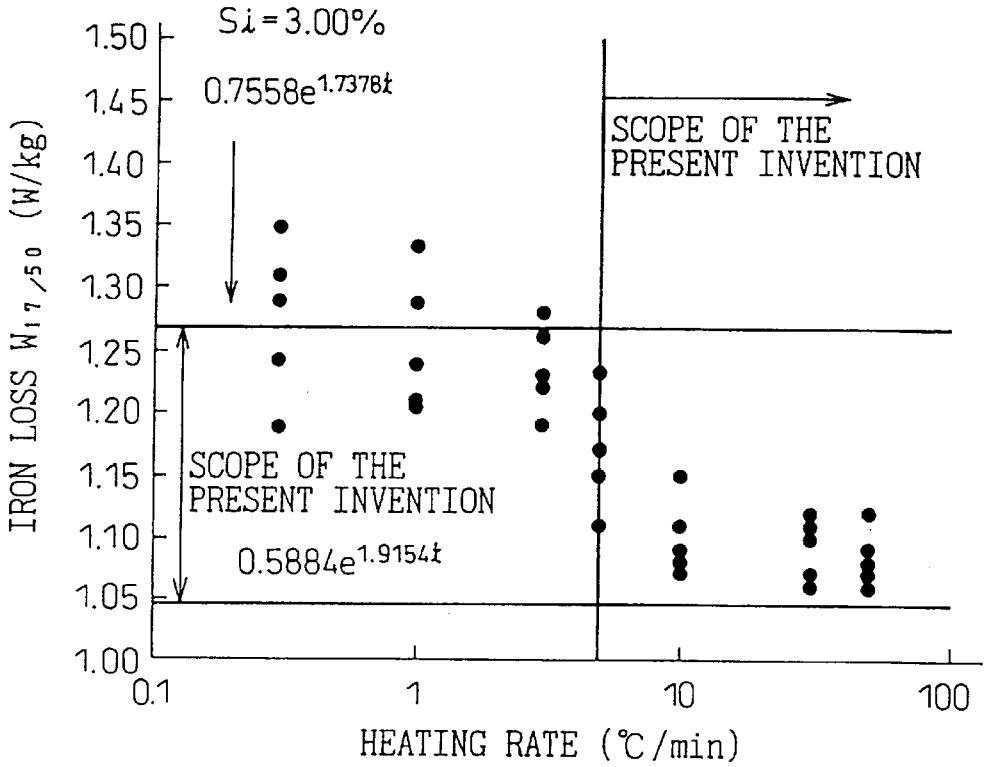
FIG. 3 is a graph showing the relationship between a slab heating rate and an iron loss in the case of Si: 3.00%.
Figure 4:
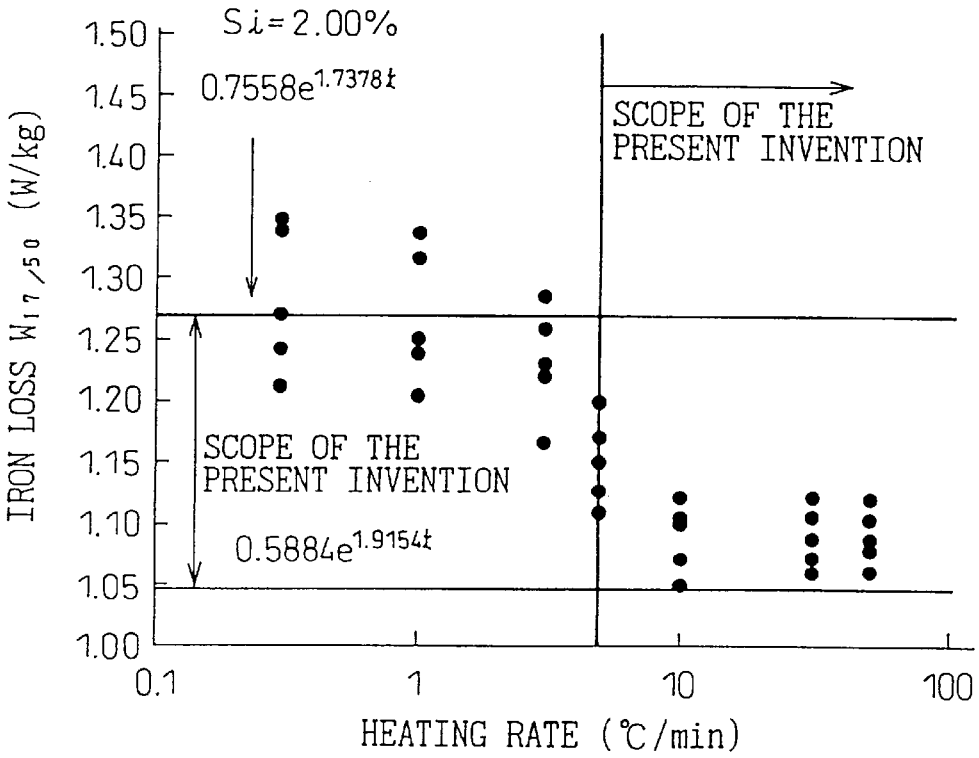
FIG. 4 is a graph showing the relationship between a slab heating rate and an iron loss in the case of Si: 2.00%.

FIG. 3 shows the result of the experiments carried out by the inventors of the present invention. Slabs containing C: 0.056%, Si: 3.00%, Mn: 0.08%, S: 0.026%, Sol. Al: 0.030% and N: 0.0089% were continuously cast. After the slabs were heated to 1,350° C. at various heating rates in an induction heating furnace, hot rolled coils having a thickness of 2.30 mm were produced. The hot rolled coils were annealed at 1,080° C., and cold rolled to a thickness of 0.300 mm and thereafter subjected to decarburization annealing, finish annealing, and flattening, and insulating and tensioning film baking annealing. FIG. 3 shows the relationship between $W_{17/50}$ of the products thus obtained and the heating rates. FIG. 4 shows the result of the experiments, wherein slabs containing C: 0.037%, Si: 2.00%, Mn: 0.08%, S: 0.028%, Sol. Al: 0.032% and N: 0.0077% were continuously cast and were heated at various heating rates in the induction heating furnace to 1,350° C. to obtain hot rolled coils having a sheet thickness of 2.30 mm. The hot rolled coils were annealed at 1,080° C., and cold rolled to a thickness of 0.300 m and were subjected serially to decarburization annealing, finish annealing, and flattening, insulating and tensioning film baking annealing. FIG. 4 shows the relationship between $W_{17/50}$ of the products thus obtained and the heating rate.

In the experiments shown in FIGS. 3 and 4, the secondary recrystallization defect partly occurred when slab heating at a temperature of not lower than 1,200° C. was carried out at a heating rate less than 5° C./min. When the heating rate was higher than 5° C./min, the average grain diameter was 2.2 to 2.6 mm. When slab heating at a temperature higher than 1,200° C. was carried out at a heating rate less than 5° C./min, variation in the iron loss was great and the iron loss was inferior in some cases. The intended iron loss ($0.5884e^{1.9154t} \leqq W_{17/50}$ (W/kg)$\leqq 0.7558e^{1.7378t}$) [t: sheet thickness (mm)] could be stably obtained at a heating rate of no lower than 5° C./min.

The causes are assumed as follows. When the slab is heated at a high temperature, the grains abnormally grow in the slab, so that the structure of the hot rolled coil becomes heterogeneous and is likely to occur variation of the magnetic properties. When the slab heating in a high temperature range of not lower than 1,200° C. is carried out at a heating rate of at least 5° C./min, the abnormal grain growth can be restricted at the time of slab heating, the structure of the hot rolled coil becomes uniform, and consequently, variation in the magnetic properties can be restricted.

The slab heating temperature is set to 1,320 to 1,490° C. If this heating temperature is less than 1,320° C., the inhibitors such as AlN, MnS and MnSe cannot be converted sufficiently to the dissolution, the secondary recrystallization is not stabilized, and the desired iron loss cannot be obtained. If the slab heating temperature exceeds 1,490° C., the slab is melted.

When hot deformation is applied to the slab to be heated to a temperature within the range of 1,320 to 1,490° C. at a reduction ratio of not higher than 50%, the columnar structure of the slab is destroyed, and this is effective for making the structure of the hot rolled coil uniform, and the magnetic properties can be further stabilized. The upper limit is set to 50% because the effect gets into saturation when the reduction ratio is increased beyond this limit.

Slab heating may be conducted in an ordinary gas heating furnace but may also be carried out in an induction heating furnace or a electric resistance heating furnace. A combination system comprising the gas heating furnace for the low temperature zone and the induction heating furnace or the electric resistance heating furnace for the high temperature zone may be used, as well.

In other words, slab heating may be carried out by the following combinations:

1) gas heating furnace (low temperature zone)-hot deformation (0 to 50%)-gas heating furnace (high temperature zone)
2) gas heating furnace (low temperature zone)-hot deformation (0 to 50%)-induction heating furnace or electric resistance heating furnace (high temperature zone)
3) induction heating furnace or electric resistance heating furnace (low temperature zone)-hot deformation (0 to 50%)-gas heating furnace (high temperature zone)
4) induction heating furnace or electric resistance heating furnace (low temperature zone)-hot deformation (0 to 50%)-gas heating furnace (high temperature zone)

Here, the term "hot deformation 0%" means that heating is done in the low temperature zone by the gas heating furnace and heating is subsequently done by the induction heating furnace or electric resistance heating furnace without subsequent hot deformation in the case of 2), for example.

When heating of the slab in a high temperature zone of not lower than 1,200° C., which is carried out at a heating rate of at least 5° C./min, is carried out by the induction heating furnace or the electric resistance heating furnace, the slag (molten ferrosilicon oxides) do not form because slab heating can be carried out in a non-oxidizing atmosphere (nitrogen, for example) in the induction heating furnace or electric resistance heating furnace. Consequently, the surface defects of the steel sheet can be decreased, and the removing of the slag deposited on the floor of the heating furnace can be eliminated.

When heating of the slab before the application of hot deformation is carried out by the gas heating furnace, slab heating can be done at a lower cost and with higher productivity than by using the induction heating furnace or the electric resistance heating furnace.

The hot rolled coil thus obtained is subsequently annealed so as to control the precipitation of the inhibitor. More particularly, the present invention carries out this hot rolled coil annealing at 900 to 1,000° C. for 30 seconds to 30 minutes. If the annealing temperature is less than 900° C., the precipitation of the inhibitor is not sufficient and the secondary recrystallization does not get stable, and if it exceeds 1,100° C., the secondary recrystallization defect is more likely to occur due to coarsening of the inhibitor. A lower temperature than the hot rolled sheet annealing temperature of 1,150° C. of the conventional grain-oriented electrical steel sheets using AlN as the inhibitor, that is, a temperature of the equal level to the intermediate annealing temperature of products of the conventional CGO grade, can be employed for this hot rolled coil annealing.

Next, the coil subjected to the hot rolled coil annealing described above is cold rolled so as to obtain the final sheet thickness.

Generally, cold rolling of the grain-oriented electrical steel sheet is conducted at least twice inclusive of intermediate annealing but the present invention is characterized in that the steel sheet is manufactured by one stage cold rolling. Though this cold rolling has been conventionally carried out by a zendimier mill or a tandem mill, the present invention conducts this cold rolling by using a tandem mill having a plurality of stands in order to reduce the cost of production and to improve productivity. In the present invention, the cold rolling is preferably carried out applying a heavy reduction ratio of 65 to 95% and more preferably, 75 to 90%. The most preferable reduction ratio is 80–86%.

Figure 5:
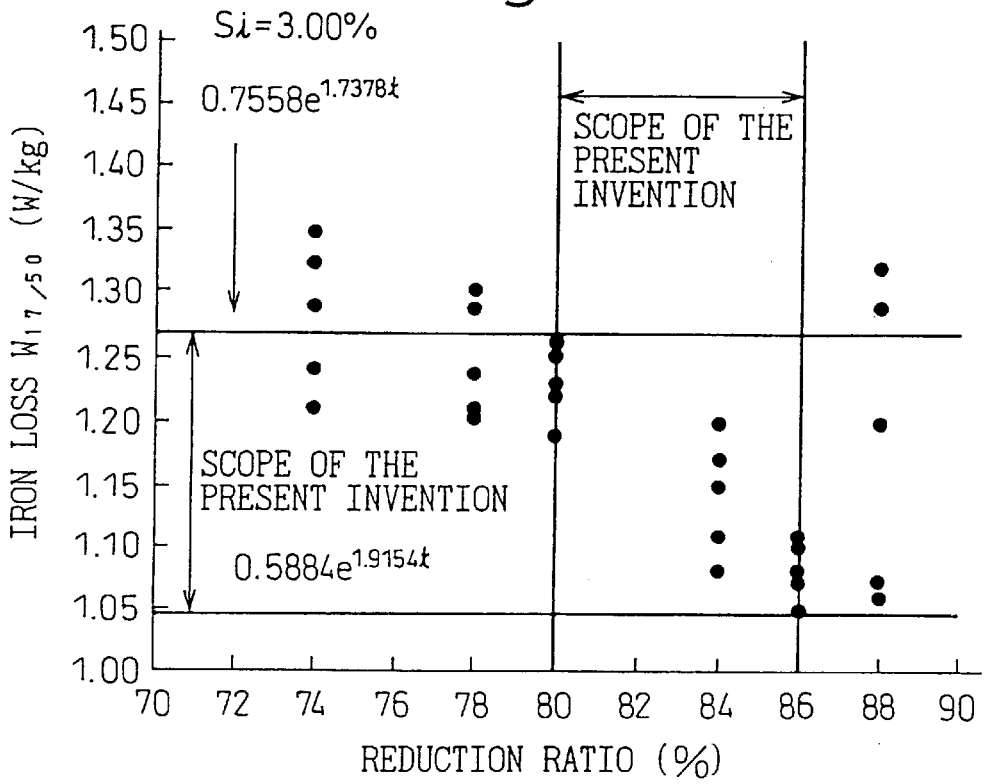
FIG. 5 is a graph showing the relationship between a cold rolling reduction ratio and an iron loss in the case of Si: 3.00%.
Figure 6:
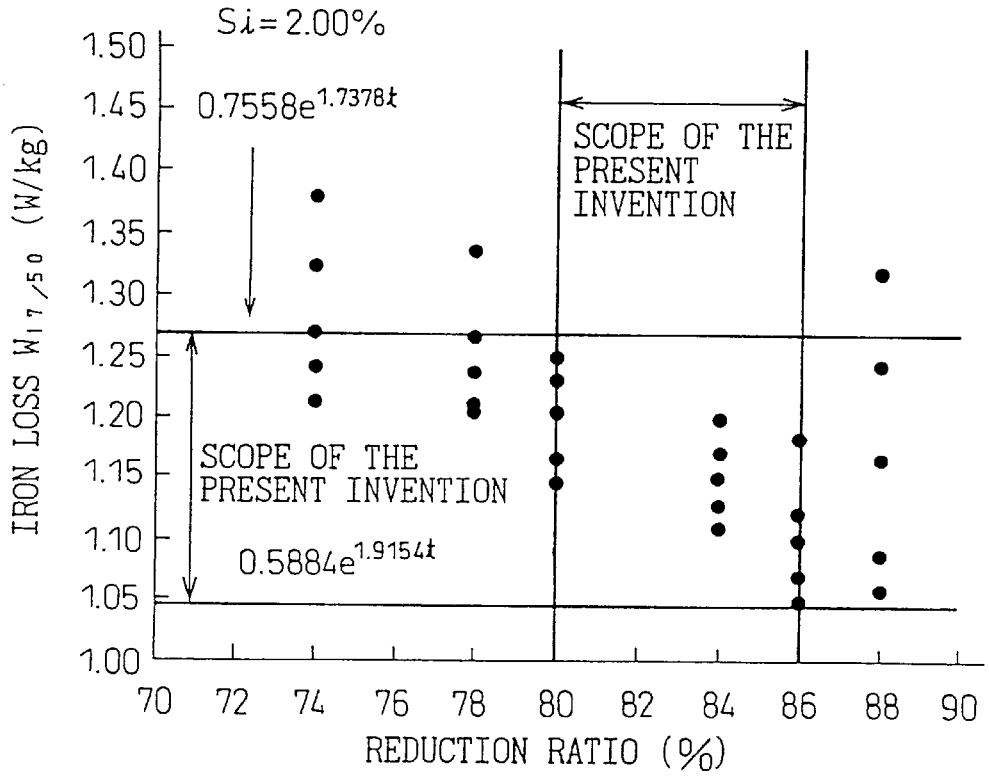
FIG. 6 is a graph showing the relationship between a cold rolling reduction ratio and an iron loss in the case of Si: 2.00%.

FIG. 5 shows the relationship between the reduction ratio and $W_{17/50}$ of the product which is obtained by the steps of hot rolling a slab containing C: 0.066%, Si: 3.00%, Mn: 0.08%, S: 0.025%, Sol. Al: 0.031% and N: 0.0090%, conducting hot rolled coil annealing at 1,080° C., conducting cold rolling at various reduction ratios to a final sheet thickness of 0.300 mm and serially conducting decarburization annealing, finish annealing, and flattening, insulating and tensioning film baking annealing. FIG. 6 shows similarly the relationship between the reduction ratio and $W_{17/50}$ of the product obtained by the steps of hot rolling a slab containing C: 0.038%, Si: 2.00%, Mn: 0.08%, S: 0.027%, Sol. Al: 0.031% and N: 0.0078%, conducting hot rolled coil annealing at 1,080° C., conducting cold rolling at various reduction ratios to a final sheet thickness of 0.300 mm, and conducting serially decarburization annealing, finish annealing, and flattening, insulating and tensioning film baking annealing. In the experiment conducted in FIG. 5 and FIG. 6, the partial secondary recrystallization defects tends to occur in case of the reduction ratio less than 80% and more than 86%. In addition, the average grain diameter of 2.2 to 2.6 mm is stably obtained when the above reduction ratio is applied. It can be appreciated from FIGS. 5 and 6 that when the reduction ratio of cold rolling is less than 80% or exceeds 86%, variation in the iron loss becomes increase, and a worse iron loss obtains in some cases. The desired iron loss ($0.5884e^{1.9154t} \leqq W_{1750}$ (W/kg)$\leqq 0.7558e^{1.7378t}$) [t: sheet thickness (mm)] can be obtained stably when the cold rolling reduction ratio is within the range of 80 to 86%.

EXAMPLES

Example 1

A slab containing C: 0.052%, Si: 3.05%, Mn: 0.08%, S: 0.024%, acid-soluble Al: 0.026% and N: 0.0080% was heated at 1,360° C. and, immediately after heating, the slab was hot rolled into a hot rolled coil having a thickness of 2.3 mm.

The hot rolled coil was annealed at 1,050° C. and was then reduced to a thickness of 0.300 and 0.268 mm by one stage cold rolling. Then, decarburization annealing and the coating of an annealing separator were carried out at 860° C., and secondary recrystallization annealing was carried out at 1,200° C.

Subsequently, a secondary film was applied to obtain the final product. Table 1 shows the characteristics of each product.

Incidentally, conventional products were produced in the following way. A slab containing C: 0.044%, Si: 3.12%, Mn: 0.06%, S: 0.024% and N: 0.0040% was heated at 1,360° C. and was immediately hot rolled to obtain a hot rolled coil having a thickness of 2.3 mm. The coil was reduced to a thickness of 0.300 and 0.269 mm by second stage cold rolling method inclusive of intermediate annealing at 840° C. Decarburization annealing and the coating of an annealing separator were then carried out at 860° C., and secondary recrystallization annealing was conducted at 1,200° C. An insulating and tensioning film was applied to obtain the final-product.

TABLE 1

| Si | Mn (%) | Acid-insol. Al | Sheet thickness (mm) | Process | Average grain diameter (mm) | $B_8$ (T) | $W_{17/50}$ (W/kg) | Remarks |
|---|---|---|---|---|---|---|---|---|
| 3.05 | 0.08 | 0.023 | 0.300 | one stage cold rolling | 2.6 | 1.880 | 1.16 | This invention |
| 3.12 | 0.06 | 0.002 | 0.300 | second stage cold rolling | 1.2 | 1.855 | 1.20 | Conventional product |
| 3.05 | 0.08 | 0.024 | 0.268 | one stage cold rolling | 2.1 | 1.878 | 1.12 | This invention |
| 3.12 | 0.06 | 0.002 | 0.269 | second stage cold rolling | 1.1 | 1.860 | 1.14 | Conventional product |

Grain-oriented electrical steel sheets exhibiting an excellent iron loss characteristic curve expressed by the formula (2) given below could be obtained by adjusting the components such as the Si content, the sheet thickness, the product average grain diameter and the combination of the textures, and simplifying the manufacturing process to such an extent that had not been achieved so far:

$$0.5884e^{1.9154t} \leqq W14/50 \leqq 0.7558e^{1.7378t} \quad (2)$$

[t: sheet thickness (mm)]

Example 2

A slab containing C: 0.032%, Si: 2.05%, Mn: 0.08%, S: 0.024%, acid-soluble Al: 0.026% and N: 0.0082% was heated at 1,360° C. and was immediately hot rolled to obtain a hot rolled coil having a thickness of 2.3 mm.

The hot rolled coil was annealed at 1,050° C. and was cold rolled by one stage cold rolling to a thickness of 0.550 and 0.270 mm. Decarburization annealing and the coating of an annealing separator were carried out at 860° C., and then secondary recrystallization annealing was carried out at 1,200° C.

Subsequently, an insulating and tensioning film was applied to obtain the final products. Table 2 tabulates the characteristics of the products. Incidentally, the conventional product was manufactured by the steps of Example 1.

TABLE 2

| Si | Mn (%) | Acid-insol. Al | Sheet thickness (mm) | Process | Average grain diameter (mm) | $B_8$ (T) | $W_{17/50}$ (W/kg) | Remarks |
|---|---|---|---|---|---|---|---|---|
| 2.05 | 0.08 | 0.022 | 0.550 | one stage cold rolling | 1.9 | 1.949 | 1.40 | This invention |
| 2.05 | 0.08 | 0.025 | 0.270 | one stage cold rolling | 3.6 | 1.938 | 1.14 | This invention |
| 3.12 | 0.06 | 0.002 | 0.269 | second stage cold rolling | 1.1 | 1.880 | 1.14 | Conventional product |

The grain-oriented electrical steel sheets exhibiting the excellent iron loss characteristics expressed by the formula (2) described above could be obtained by adjusting the components such as the Si content, the sheet thickness, the product average grain diameter and the combination of the textures, and simplifying the manufacturing process to such an extent that had not been achieved so far.

Example 3

A slab containing C: 0.063%, Si: 2.85%, Mn: 0.08%, S: 0.025%, acid-soluble Al: 0.028%, N: 0.0079% and Sn: 0.08% was heated at 1,350° C. and was immediately hot rolled to a hot rolled coil having a thickness of 2.0 mm.

The hot rolled coil was annealed at 1,020° C. and was cold rolled by one stage cold rolling to a thickness of 0.30 and 0.20 mm. Decarburization annealing and the coating of an annealing separator were carried out at 850° C., and secondary recrystallization annealing was carried out at 1,200° C.

Subsequently, an insulating and tensioning film was applied to obtain the final products. Table 3 tabulates the characteristics of the products. Incidentally, the conventional product was manufactured by the steps of Example 1.

TABLE 3

| Si | Mn | Acid-insol. Al (%) | Sn | Sheet thickness (mm) | Process | Average grain diameter (mm) | $B_8$ (T) | $W_{17/50}$ (W/kg) | Remarks |
|---|---|---|---|---|---|---|---|---|---|
| 2.85 | 0.08 | 0.024 | 0.07 | 0.30 | one stage cold rolling | 1.6 | 1.868 | 1.16 | This invention |
| 3.12 | 0.06 | 0.002 | 0.07 | 0.30 | second stage cold rolling | 1.1 | 1.855 | 1.18 | Conventional product |
| 2.85 | 0.06 | 0.024 | 0.07 | 0.20 | one stage cold rolling | 2.9 | 1.874 | 0.94 | This invention |

The grain-oriented electrical steel sheets exhibiting the excellent iron loss characteristic curve expressed by the formula (2) could be obtained by adjusting the components such as the Si content, the sheet thickness, the product average grain diameter and the combination of the textures, and simplifying the manufacturing process to such an extent that had not been achieved so far.

Example 4

A slab containing C: 0.028%, Si: 2.44%, Mn: 0.08%, S: 0.025%, acid-soluble Al: 0.030%, N: 0.0078% and Sn: 0.05% was heated at 1,350° C. and was immediately hot rolled to a hot rolled coil having a thickness of 2.5 mm.

The hot rolled coil was annealed at 1,000° C. and was cold rolled to a thickness of 0.35 and 0.30 mm by one stage cold rolling. Decarburization annealing and the coating of an annealing separator were carried out at 850° C. and secondary recrystallization annealing was carried out at 1,200° C.

Subsequently, an insulating and tensioning film was applied to obtain the final products. Table 4 tabulates the characteristics of the products. Incidentally, the conventional product was produced by the manufacturing process of Example 1.

TABLE 4

| Si | Mn | Acid-insol. Al (%) | Sn | Sheet thickness (mm) | Process | Average grain diameter (mm) | $B_8$ (T) | $W_{17/50}$ (W/kg) | Remarks |
|---|---|---|---|---|---|---|---|---|---|
| 2.44 | 0.08 | 0.026 | 0.05 | 0.35 | one stage cold rolling | 2.9 | 1.936 | 1.30 | This invention |
| 3.12 | 0.06 | 0.002 | 0.05 | 0.35 | second stage cold rolling | 0.9 | 1.846 | 1.32 | Conventional product |
| 2.44 | 0.06 | 0.027 | 0.05 | 0.30 | one stage cold rolling | 3.9 | 1.938 | 1.16 | This invention |
| 3.12 | 0.08 | 0.002 | 0.05 | 0.20 | second stage cold rolling | 1.2 | 1.852 | 1.18 | Conventional product |

The grain-oriented electrical steel sheets having the excellent iron loss characteristic curve expressed by the formula (2) could be obtained by adjusting the components such as the Si content, the sheet thickness, the product average grain diameter and the combination of the textures, and simplifying the manufacturing process to such an extent that had not been achieved so far.

Example 5

A molten steel containing C: 0.07%, Si: 3.15%, Mn: 0.08%, S: 0.026%, acid-soluble Al: 0.030%, N: 0.0078%, Sn: 0.05% and Cu: 0.05% was directly cast to a coil having a thickness of 2.5 mm.

The hot rolled coil was annealed at 950° C., and was cold rolled to a thickness of 0.280 mm by one stage cold rolling. Decarburization annealing and the coating of an annealing separating agent were carried out at 850° C., and secondary recrystallization annealing was carried out at 1,200° C.

Subsequently, an insulating and tensioning film was applied to obtain the final products. Table 5 tabulates the characteristics of the products. Incidentally, the conventional product was manufactured by the manufacturing process of Example 1.

TABLE 5

| Si | Mn | Acid-insol. Al (%) | Sn | Cu | Process | Average grain diameter (mm) | $B_8$ (T) | $W_{17/50}$ (W/kg) | Remarks |
|---|---|---|---|---|---|---|---|---|---|
| 3.15 | 0.08 | 0.026 | 0.05 | 0.05 | one stage cold rolling | 2.5 | 1.880 | 1.15 | This invention |
| 3.12 | 0.06 | 0.002 | 0.05 | 0.05 | second stage cold rolling | 1.0 | 1.846 | 1.18 | Conventional product |

The grain-oriented electrical steel sheets exhibiting the excellent iron loss characteristic curve expressed by the formula (2) could be obtained by adjusting the components such as the Si content, the sheet thickness, the product average grain diameter and the combination of the textures, and simplifying the manufacturing process to such an extent that had not been achieved so far.

Example 6

A slab containing C: 0.02%, Si: 1.85%, Mn: 0.08%, S: 0.026%, acid-soluble Al: 0.030%, N: 0.0078%, Sn: 0.05% and Cu: 0.05% was heated at 1,360° C. and was then hot rolled to a hot rolled coil having a thickness of 2.3 mm.

The hot rolled coil was annealed at 950° C. and was then cold rolled to a thickness of 0.255 mm by one stage cold rolling. Decarburization annealing and the coating of an annealing separator were carried out at 850° C. and secondary recrystallization annealing was carried out at 1,200° C.

Subsequently, an insulating and tensioning film was applied to obtain the final products. Table 6 tabulates the characteristics of the products. Incidentally, the conventional product was manufactured by the manufacturing process of Example 1.

TABLE 6

| Si | Mn | Acid-insol. Al (%) | Sn | Cu | Process | Average grain diameter (mm) | $B_8$ (T) | $W_{17/50}$ (W/kg) | Remarks |
|---|---|---|---|---|---|---|---|---|---|
| 1.85 | 0.08 | 0.027 | 0.05 | 0.05 | one stage cold rolling | 2.5 | 1.950 | 1.12 | This invention |
| 3.12 | 0.06 | 0.002 | 0.05 | 0.05 | second stage cold rolling | 1.0 | 1.846 | 1.14 | Conventional product |

The grain-oriented electrical steel sheet exhibiting the excellent iron loss characteristic curve expressed by the formula (2) could be obtained by adjusting the components such as the Si content, the sheet thickness, the product average grain diameter and the combination of the textures, and simplifying the manufacturing process to such an extent that had not been achieved so far.

Example 7

A slab containing C: 0.07%, Si: 3.50%, Mn: 0.08%, Se: 0.026%, acid-soluble Al: 0.030%, N: 0.0078%, Sb: 0.02% and Mo: 0.02% was heated at 1,360° C. and was then hot rolled to a hot rolled coil having a thickness of 2.4 mm.

The hot rolled coil was annealed at 1,025° C. and was cold rolled to a thickness of 0.290 mm by one stage cold rolling. Decarburization annealing and the coating of an annealing separator were carried out at 850° C. and secondary recrystallization annealing was carried out at 1,200° C.

Subsequently, an insulating and tensioning film was applied to obtain the final products. Table 7 tabulates the characteristics of the products. Incidentally, the conventional product was manufactured by the manufacturing process of Example 1.

TABLE 7

| Si | Mn | Acid-insol. Al (%) | Sb | Mo | Process | Average grain diameter (mm) | $B_8$ (T) | $W_{17/50}$ (W/kg) | Remarks |
|---|---|---|---|---|---|---|---|---|---|
| 3.05 | 0.08 | 0.022 | 0.02 | 0.02 | one stage cold rolling | 2.5 | 1.840 | 1.15 | This invention |
| 3.12 | 0.06 | 0.002 | Tr. | Tr. | second stage cold rolling | 1.0 | 1.840 | 1.19 | Conventional product |

The grain-oriented electrical steel sheet exhibiting the excellent iron loss characteristic curve could be obtained by adjusting the components such as the Si content, the sheet thickness, the product average grain diameter and the combination of the textures and simplifying the manufacturing process to such an extent that had not been achieved so far.

Example 8

A slab containing C: 0.035%, Si: 2.20%, Mn: 0.08%, Se: 0.026%, acid-soluble Al: 0.030%, N: 0.0078%, Sb: 0.02% and Mo: 0.02% was heated at 1,360° C. and was hot rolled to a hot rolled coil having a thickness of 2.4 mm.

The hot rolled coil was annealed at 1,050° C. and was cold rolled to a thickness of 0.290 mm by one stage cold rolling. Decarburization annealing and the coating of an annealing separator were carried out at 850° C. and secondary recrystallization annealing was carried out at 1,200° C.

Subsequently, an insulating and tensioning film was applied to obtain the final products. Table 8 tabulates the characteristics of the products. Incidentally, the conventional product was manufactured by the manufacturing process of Example 1.

TABLE 8

| Si | Mn | Acid-insol. Al (%) | Sb | Mo | Process | Average grain diameter (mm) | $B_8$ (T) | $W_{17/50}$ (W/kg) | Remarks |
|---|---|---|---|---|---|---|---|---|---|
| 3.20 | 0.08 | 0.022 | 0.02 | 0.02 | one stage cold rolling | 3.6 | 1.948 | 1.17 | This invention |

TABLE 8-continued

| Si | Mn | Acid-insol. Al (%) | Sb | Mo | Process | Average grain diameter (mm) | $B_8$ (T) | $W_{17/50}$ (W/kg) | Remarks |
|---|---|---|---|---|---|---|---|---|---|
| 3.12 | 0.06 | 0.002 | Tr. | Tr. | second stage cold rolling | 1.0 | 1.840 | 1.19 | Conventional product |

Example 9

A slab containing C: 0.053%, Si: 3.05%, Mn: 0.08%, S: 0.024%, acid-soluble Al: 0.026% and N: 0.0080% was heated at 1,360° C. and was immediately hot rolled to obtain a hot rolled coil having a thickness of 2.3 mm.

The hot rolled coil was annealed at 1,050° C. and was cold rolled to a thickness of 0.300 mm. Decarburization annealing and an coating of the annealing separator were carried out at 830 to 860° and secondary recrystallization annealing was carried out at 1,200° C.

Subsequently, an insulating and tensioning film was applied to obtain the final products, Table 9 tabulates the characteristics of the products. Incidentally, the conventional product was manufactured by the manufacturing process of Example 1.

TABLE 9

| Si | Mn (%) | Acid-insol. Al | Sheet thickness (mm) | Process | Average grain diameter (mm) | $B_8$ (T) | $W_{17/50}$ (W/kg) | Remarks |
|---|---|---|---|---|---|---|---|---|
| 3.05 | 0.08 | 0.023 | 0.300 | one stage cold rolling | 2.6 | 1.880 | 1.16 | This invention |
| 3.05 | 0.08 | 0.023 | 0.300 | one stage cold rolling | 5.8 | 1.880 | 1.30 | This invention |
| 3.12 | 0.06 | 0.002 | 0.300 | second stage cold rolling | 1.2 | 1.855 | 1.20 | Conventional product |

The grain-oriented electrical steel sheets exhibiting the excellent iron loss characteristic curve expressed by the formula (2) could be obtained by adjusting the components such as the Si content, the sheet thickness, the product average grain diameter and the combination of the textures, and simplifying the manufacturing process to such an extent that had not been achieved so far.

Example 10

A slab having a component system A comprising [C]: 0.050%, [Si]: 2.92%, [Mn]: 0.08%, [S]: 0.022%, [Sol. Al]: 0.023% and [N]: 0.0088% was heated at various heating rates in the temperature zone of not lower than 1,200° C. in an induction heating furnace, and the slab was heated to 1,350° C. Thereafter, the slab was hot rolled to a thickness of 2.0 mm, was hot rolled and hot rolled coil annealing at 1,060° C., and cold rolled to a thickness of 0.300 mm by one stage cold rolling. Thereafter, decarburization annealing, finish annealing and flattening/insulating and tensioning film baking annealing were carried out to obtain the final products.

On the other hand, a slab having a component system B comprising C: 0.038%, [Si]: 3.05%, [Mn]: 0.06%, [S]: 0.026%, [Sol. Al]: 0.001% and [N]: 0.0037% was heated to 1,350° C. at a heating rate of 10° C./min in the temperature zone of not lower than 1,200° C. in an induction heating furnace, and was hot rolled to obtain a hot coil having a thickness of 2.0 mm. The hot rolled coil was then cold rolled to a thickness of 0.300 mm by second stage cold rolling inclusive of intermediate annealing at 840° C. Thereafter, decarburization annealing, finish annealing, and flattening, insulating and tensioning film baking annealing were carried out to obtain the final products.

As tabulated in Table 10, it can be appreciated that the products of the present invention could provide the excellent magnetic properties by the one stage cold rolling method.

TABLE 10

| Component system | Process | Heating rate (° C./min) | Average grain diameter (mm) | $B_8$ (T) | $W_{17/50}$ (W/kg) | Remarks |
|---|---|---|---|---|---|---|
| A | one stage cold rolling method | 1 | secondary recrystallization defect occurred | 1.777<br>1.820<br>1.842 | 1.31<br>1.28<br>1.23 | Comp. Example |
| A | one stage cold rolling method | 3 | 2.4 | 1.869<br>1.820<br>1.855 | 1.16<br>1.29<br>1.23 | Comp. Example |
| A | one stage cold rolling | 5 | 2.5 | 1.873<br>1.860<br>1.859 | 1.09<br>1.16<br>1.24 | Example of this invention |

TABLE 10-continued

| Component system | Process | Heating rate (° C./min) | Average grain diameter (mm) | $B_8$ (T) | $W_{17/50}$ (W/kg) | Remarks |
|---|---|---|---|---|---|---|
| | method | | | | | |
| A | one stage cold rolling method | 10 | 2.5 | 1.877<br>1.879<br>1.876 | 1.11<br>1.05<br>1.08 | Example of this invention |
| B | second stage cold rolling | 10 | 1.2 | 1.851 | 1.20 | Comp. Example |

TABLE 10-continued

| Component system | Process | Heating rate (° C./min) | Average grain diameter (mm) | $B_8$ (T) | $W_{17/50}$ (W/kg) | Remarks |
|---|---|---|---|---|---|---|
| | method | | | | | |

Example 11

Slabs each containing [C]: 0.050%, [Si]: 2.92%, [Mn]: 0.08%, [S]: 0.022%, [Sol. Al]: 0.023% and [N]: 0.0088% were heated to 1,150° C. in a gas heating furnace. Thereafter, some of the slabs were subjected to hot deformation at various reduction ratios, were then heated at various heating rates in the temperature zone of not lower than 1,200° C. in the gas heating furnace and an induction heating furnace (nitrogen atmosphere) and was heated to 1,375° C. Thereafter, the slabs were hot rolled to a thickness of 2.0 mm, were annealed at 1,040° C. and were cold rolled by one stage cold rolling to a thickness of 0.300 mm. Decarburization annealing, finish annealing, and flattening and insulating and tensioning film baking annealing were carried out to obtain the products.

As tabulated in Table 11, it can be appreciated that the products of the present invention could obtain the excellent magnetic properties by the one stage cold rolling method.

TABLE 11

| No. | Hot deformation reduction ratio (%) | Heating furnace | Slab heating rate (° C./min) | Average grain diameter (mm) | $B_8$ (T) | $W_{17/50}$ (W/kg) | Surface detect | Remarks |
|---|---|---|---|---|---|---|---|---|
| 1 | 0 | gas heating furnace | 1 | Secondary recrystallization defect occurred | 1.789<br>1.822<br>1.860 | 1.36<br>1.30<br>1.11 | Yes | Comp. Example |
| 2 | 0 | induction heating furnace | 1 | Secondary recrystallization defect occurred | 1.777<br>1.828<br>1.853 | 1.35<br>1.29<br>1.14 | Nil | Comp. Example |
| 3 | 0 | induction heating furnace | 5 | 2.5 | 1.855<br>1.859<br>1.854 | 1.07<br>1.04<br>1.10 | Nil | Example of this invention |
| 4 | 0 | induction heating furnace | 10 | 2.5 | 1.862<br>1.868<br>1.869 | 1.05<br>1.07<br>1.09 | Nil | Example of this invention |
| 5 | 20 | gas heating furnace | 1 | Secondary recrystallization occurred | 1.800<br>1.828<br>1.858 | 1.33<br>1.29<br>1.12 | Yes | Comp. Example |
| 6 | 20 | induction heating furnace | 1 | Secondary recrystallization defect occurred | 1.802<br>1.833<br>1.860 | 1.32<br>1.26<br>1.10 | Nil | Comp. Example |
| 7 | 20 | induction heating furnace | 5 | 2.4 | 1.870<br>1.870<br>1.876 | 1.08<br>1.07<br>1.06 | Nil | Example of this invention |
| 8 | 20 | induction heating furnace | 10 | 2.5 | 1.877<br>1.877<br>1.880 | 1.07<br>1.06<br>1.06 | Nil | Example of this invention |

Example 12

A slab having a component system A comprising [C]: 0.052%, [Si]: 2.95%, [Mn]: 0.07%, [S]: 0.026%, [Sol. Al]: 0.023% and [N]: 0.0089% was heated and was then hot rolled to obtain hot coils having various sheet thickness. The hot rolled coils were annealed at 1,050° C. and were cold rolled to a thickness of 0.300 mm at various reduction ratios by one stage cold rolling. Thereafter, decarburization annealing, finish annealing, and flattening, and insulating and tensioning film baking annealing were carried out to obtain the products.

On the other hand, a slab having a component system B of the conventional method comprising [C]: 0.039%, [Si]: 3.08%, [Mn]: 0.06%, [S]: 0.023%, [Sol. Al]: 0.001% and [N]: 0.0038 was heated and was hot rolled to obtain a thickness of 2.3 mm. The hot rolled coil was cold rolled to a thickness of 0.300 mm by second stage cold rolling inclusive of intermediate annealing at 840° C. Thereafter, decarburization annealing, finish annealing, and flattening, and insulating and tensioning film baking annealing were carried out to obtain the products. It can be appreciated from Table 12 that the products according to the example of the present invention could provide the excellent magnetic properties with high productivity of cold rolling by the one stage cold rolling method.

TABLE 12

| Component system | Process | Hot rolled sheet thickness (mm) | Cold rolling reduction ratio (%) | Average grain diameter (mm) | $B_8$ (T) | $W_{17/50}$ (W/kg) | Remarks |
|---|---|---|---|---|---|---|---|
| A | one stage cold rolling method | 1.4 | 78 | secondary recrystall-ization defect occurred | 1.787<br>1.840<br>1.852 | 1.30<br>1.25<br>1.22 | Comp. Example |
| A | one stage rolling method | 1.5 | 80 | 2.4 | 1.869<br>1.842<br>1.855 | 1.16<br>1.25<br>1.23 | Example of this invention |
| A | one stage cold rolling method | 1.9 | 84 | 2.5 | 1.872<br>1.862<br>1.855 | 1.08<br>1.15<br>1.22 | Example of this invention |
| A | one stage cold rolling method | 2.1 | 86 | 2.5 | 1.878<br>1.879<br>1.877 | 1.05<br>1.05<br>1.06 | Example of this invention |
| A | one stage cold rolling method | 2.5 | 88 | secondary recrystall-ization defect occurred | 1.799<br>1.862<br>1.872 | 1.29<br>1.16<br>1.06 | Comp. Example |
| B | second stage cold rolling method | 2.3 | note 1 | 1.2 | 1.851 | 1.20 | Comp. Example |

Note 1:
first rolling reduction ratio: 67% second cold rolling reduction ratio: 60%

Example 13

A slab having a component system A comprising [C]: 0.030%, [Si]: 2.08%, [Mn]: 0.08%, [S]: 0.027%, [Sol. Al]: 0.025% and [N]: 0.0090% was heated and was then hot rolled to obtain hot coils having various thickness. The hot coils were annealed at 1,060° C. and were cold rolled to a thickness of 0.350 mm at various reduction ratios by one stage cold rolling. Thereafter, decarburization annealing, finish annealing, and flattening, and insulating and tensioning film baking annealing were carried out to obtain the final products.

On the other hand, a slab having a component system B of the conventional method comprising [C]: 0.040%, [Si]: 3.09%, [Mn]: 0.06%, [S]: 0.024%, [Sol. Al]: 0.001% and [N]: 0.0039% was heated and was then hot rolled to obtain hot coils having a thickness of 2.3 mm. The hot coil were cold rolled to a thickness of 0.350 mm by second stage cold rolling inclusive of intermediate annealing at 840° C. Thereafter, decarburization annealing, finish annealing, and flattening, and insulating and tensioning film baking annealing were carried out. It can be appreciated from Table 13 that the products according to the example of the present invention could provide the excellent magnetic properties by the one stage cold rolling method.

TABLE 13

| Component system | Process | Hot rolled sheet thickness (mm) | Cold rolling reduction ratio (%) | Average grain diameter (mm) | $B_8$ (T) | $W_{17/50}$ (W/kg) | Remarks |
|---|---|---|---|---|---|---|---|
| A | one stage cold rolling method | 1.4 | 78 | secondary recrystall-ization defect occurred | 1.788<br>1.841<br>1.855 | 1.45<br>1.35<br>1.34 | Comp. Example |
| A | one | 1.5 | 80 | 2.4 | 1.868 | 1.33 | Example |

TABLE 13-continued

| Component system | Process | Hot rolled sheet thickness (mm) | Cold rolling reduction ratio (%) | Average grain diameter (mm) | $B_8$ (T) | $W_{17/50}$ (W/kg) | Remarks |
|---|---|---|---|---|---|---|---|
| | stage cold rolling method | | | | 1.840<br>1.856 | 1.35<br>1.35 | of this invention |
| A | one stage cold rolling method | 1.9 | 84 | 2.5 | 1.873<br>1.859<br>1.858 | 1.22<br>1.23<br>1.24 | Example of this invention |
| A | one stage cold rolling method | 2.1 | 86 | 2.5 | 1.877<br>1.878<br>1.879 | 1.18<br>1.19<br>1.18 | Example of this invention |
| A | one stage cold rolling method | 2.5 | 88 | secondary recrystall-ization defect occurred | 1.799<br>1.862<br>1.872 | 1.48<br>1.22<br>1.21 | Comp. Example |
| B | second stage cold rolling method | 2.3 | note 1 | 1.2 | 1.849 | 1.37 | Comp. Example |

Note 1:
first cold rolling reduction ratio: 62% second cold rolling reduction ratio: 60%

Example 14

A slab having a component system A comprising [C]: 0.051%, [Si]: 2.99%, [Mn]: 0.08%, [S]: 0.027%, [Sol. Al]: 0.022% and [N]: 0.00905 was heated and was then hot rolled to obtain a hot coil having a thickness of 2.3 mm. The hot coil was annealed at 1,050° C. and was cold rolled to a thickness of 0.300 mm by one stage cold rolling by a tandem mill or zendimier mill having a plurality of stands. Thereafter, decarburization annealing, finish annealing, and flattening, and insulating and tensioning film baking annealing were carried out to obtain the products.

On the other hand, a slab B of the conventional method having a component system B comprising [C]: 0.040%, [Si]: 3.09%, [Mn]: 0.06%, [S]: 0.024%, [Sol. Al]: 0.001% and [N]: 0.0039% was heated and was then hot rolled to a hot coil having a thickness of 2.3 mm. The hot coil was then cold rolled to a thickness of 0.300 mm by second stage cold rolling inclusive of intermediate annealing at 840° C. by a tandem mill or zendimier mill having a plurality of stands. Thereafter, decarburization annealing, finish annealing, and flattening, and insulating and tensioning film baking annealing were carried out to obtain the final products. It can be appreciated from Table 14 that the products according to the example of the present invention could obtain the excellent magnetic properties with high productivity of cold rolling by the one stage cold rolling method.

TABLE 14

| Component system | Process | Cold rolling | Cold rolling productivity (T/h) | Average grain diameter (mm) | $B_8$ (T) | $W_{17/50}$ (W/kg) | Remarks |
|---|---|---|---|---|---|---|---|
| A | one stage cold rolling method | ZM | 20 | 2.5 | 1.879 | 1.16 | Example of this invention |
| A | one stage cold rolling method | TCM | 80 | 2.5 | 1.878 | 1.16 | Example of this invention |
| B | second stage cold rolling method | ZM | 18 | 1.1 | 1.853 | 1.19 | Comp. Example |

TABLE 14-continued

| Component system | Process | Cold rolling | Cold rolling productivity (T/h) | Average grain diameter (mm) | $B_8$ (T) | $W_{17/50}$ (W/kg) | Remarks |
|---|---|---|---|---|---|---|---|
| B | second stage cold rolling method | TCM | 76 | 1.2 | 1.851 | 1.20 | Comp. Example |

Note 1:
ZM: zendimier mill, TCM: tandem mill
Note 2:
Cold rolling productivity of second stage cold rolling method was the sum of first and second cold rolling.

INDUSTRIAL APPLICABILITY

A grain-oriented electrical steel sheet exhibiting an excellent iron loss curve can be obtained by adjusting components such as a Si content, a sheet thickness, a product average grain diameter size and the combination of textures, and simplifying the manufacturing steps to such an extent that has not been achieved in the conventional method.

What is claimed is:

1. A grain-oriented electrical steel sheet having a B8 value satisfying the relation $1.80 \leqq B_8$ (T)$\leqq 1.88$, containing, in terms of percent by weight, 2.5 to 4.0%, of Si, 0.02 to 0.20% of Mn, and 0.005 to 0.050% of acid-insoluble Al, and having an average grain diameter of 1.5 to 5.5 mm and a $W_{17/50}$ value satisfying the formula given below at a sheet thickness of 0.20 to 0.55 mm:

$$0.5884e^{1.9154t} \leqq W17/50(W/kg) \leqq 0.7558e^{1.7378t}$$

wherein t is sheet thickness (mm).

2. A grain-oriented electrical steel sheet having a B8 value satisfying the relation $1.88 \leqq B_8$ (T)$\leqq 1.95$, containing, in terms of percent by weight, 1.5 to less than 2.5%, of Si, 0.02 to 0.20% of Mn, and acid-insoluble Al of 0.005 to 0.050%, and having an average grain diameter of 1.5 to 5.5 mm and a $W_{17/50}$ value satisfying the formula given below at a sheet thickness of 0.20 to 0.55 mm:

$$0.5884e^{1.9154t} \leqq W17/50(W/kg) \leqq 0.7558e^{1.7378t}$$

wherein t is sheet thickness (mm).

3. A grain-oriented electrical steel sheet according to claim 1, which further contains 0.003 to 0.3%, in terms of each element amount, of at least one element selected from the group consisting of Sb, Sn, Cu, Mo and B.

4. A method for producing a grain-oriented electrical steel sheet having a $B_8$ value satisfying the relation $1.80 \leqq B_8$ (T)$\leqq 1.88$, by using, as a starting material, a coil obtained by heating a slab formed from molten steel and hot rolling the slab or obtained by direct casting from the molten steel, the molten steel having a composition comprising, in terms of percent by weight, 0.02 to 0.15%; of C, 2.5 to 4.0% of Si, 0.02 to 0.20% of Mn, 0.015 to 0.065% of Sol. Al, 0.0030 to 0.0150%of N, 0.005 to 0.040% as the sum of at least one of S and Se and the balance substantially consisting of Fe, comprising the steps of annealing the coil, and then carrying out cold rolling, serially decarburization annealing, final finish annealing and final coating, characterized in that annealing of said coil is carried out at 900 to 1,100° C. so that a grain-oriented electrical steel sheet has a thickness of 0.20 to 0.55 mm, an average grain diameter of 1.5 to 5.5 mm and a $W_{17/50}$ value expressed by the formula given below:

$$0.5884e^{1.9154t} \leqq W17/50(W/kg) \leqq 0.7558e^{1.7378t}$$

wherein t is sheet thickness (mm).

5. A method for producing a grain-oriented electrical steel sheet having a $B_8$ value satisfying the relation $1.88 \leqq B_8$ (T)$\leqq 1.95$ by using, as a starting material, a coil obtained by heating a slab formed from molten steel and hot rolling the slab or obtained by direct casting from the molten steel, the molten steel having a composition comprising, in terms of percent by weight, 0.02 to 0.15% of C, 1.5 to less than 2.5% of Si, 0.02 to 0.20% of Mn, 0.015 to 0.65% of Sol. Al, 0.0030 to 0.0150% of N, 0.005 to 0.040% as the sum of at least one of S and Se and the balance substantially consisting of Fe, comprising the steps of annealing the coil and then carrying out cold rolling, serially decarburization annealing, finish annealing, and final coating, characterized in that annealing of said coil is carried out at 900 to 1,100° C. so that a grain oriented electrical sheet has a sheet thickness of 0.20 to 0.55 mm, an average grain diameter of 1.5 to 5.5 mm and a $W_{17/50}$ value expressed by the formula given below:

$$0.5884e^{1.9154t} \leqq W17/50(W/kg) \leqq 0.7558e^{1.7378t}$$

wherein t is sheet thickness (mm).

6. A method for producing a grain-oriented electrical steel sheet according to claim 4, which further contains, in terms of each element amount, 0.003 to 0.3% of at least one element selected from the group consisting of Sb, Sn, Cu, Mo and B.

7. A method a for producing grain-oriented electrical steel sheet according to claim 4, wherein cold rolling is carried out at a reduction ratio of 65 to 95%.

8. A method for producing a grain-oriented electrical steel sheet according to claim 4, wherein cold rolling is carried out at a reduction ratio of 80 to 86%.

9. A method for producing a grain-oriented electrical steel sheet according to claim 7, wherein cold rolling is carried out by a tandem mill having a plurality of stands or zendimier mill.

10. A method for producing a grain-oriented electrical steel sheet according to claim 4, wherein heating of slab in a high temperature zone of not lower than 1,200° C. is carried out to 1,320 to 1,490° C. at a heating rate of at least 5° C./min.

11. A method for producing a grain-oriented electrical steel sheet according to claim 10, wherein said slab to be heated to a temperature within the range of 1,320 to 1,490° C. is a slab to which hot deformation is applied at a reduction ratio of not higher than 50%.

* * * * *